US009134034B2

(12) United States Patent
Han et al.

(10) Patent No.: US 9,134,034 B2
(45) Date of Patent: Sep. 15, 2015

(54) DUAL FUNCTION AIR CHANNEL FOR GAS BURNER

(75) Inventors: Bai Han, Louisville, KY (US); Paul Bryan Cadima, Prospect, KY (US)

(73) Assignee: General Electric Company, Schenectady, NY (US)

( * ) Notice: Subject to any disclaimer, the term of this patent is extended or adjusted under 35 U.S.C. 154(b) by 748 days.

(21) Appl. No.: 13/419,698

(22) Filed: Mar. 14, 2012

(65) Prior Publication Data

US 2013/0239945 A1 Sep. 19, 2013

(51) Int. Cl.
*F24C 3/08* (2006.01)
*F24C 15/32* (2006.01)

(52) U.S. Cl.
CPC ..... *F24C 3/087* (2013.01); *F24C 15/32* (2013.01)

(58) Field of Classification Search
CPC ..... F24C 3/047; F24C 3/087; F24C 14/025
USPC ..... 126/19 R, 39 R, 41 R, 273 R
See application file for complete search history.

(56) References Cited

U.S. PATENT DOCUMENTS

| | | | | | |
|---|---|---|---|---|---|
| 3,338,231 | A | * | 8/1967 | Lamar | 126/39 E |
| 3,590,804 | A | * | 7/1971 | Welshofer et al. | 126/11 |
| 3,590,805 | A | * | 7/1971 | Perl | 126/21 A |
| 3,596,651 | A | * | 8/1971 | Welshofer et al. | 126/190 |
| 3,624,742 | A | * | 11/1971 | Hurko et al. | 126/39 D |
| 3,645,248 | A | * | 2/1972 | Kemp | 126/39 E |
| 3,682,156 | A | * | 8/1972 | Perl | 126/21 A |
| 3,915,149 | A | * | 10/1975 | Kemp | 126/273 R |
| 3,951,335 | A | * | 4/1976 | Kemp | 236/15 A |
| RE29,602 | E | * | 4/1978 | Perl | 126/21 A |
| 4,375,213 | A | * | 3/1983 | Kemp et al. | 126/21 A |
| 4,598,691 | A | * | 7/1986 | Herrelko et al. | 126/41 R |
| 4,763,638 | A | * | 8/1988 | Hurley et al. | 126/21 A |
| 4,796,600 | A | * | 1/1989 | Hurley et al. | 126/273 A |
| 4,802,459 | A | * | 2/1989 | McFadden et al. | 126/41 R |
| 5,080,087 | A | | 1/1992 | McFadden et al. | |
| 2003/0037780 | A1 | * | 2/2003 | Wiersma et al. | 126/21 R |

* cited by examiner

*Primary Examiner* — Jorge Pereiro
(74) *Attorney, Agent, or Firm* — Dority & Manning, P.A.

(57) ABSTRACT

A gas oven includes an oven cavity, an upper gas burner disposed within the oven cavity, a venturi assembly coupled to the upper gas burner, a lower gas burner disposed within a lower burner combustion chamber. The channel member is communicatively coupled between the lower burner combustion chamber and the venturi assembly for the upper gas burner to provide an airflow path therebetween.

16 Claims, 5 Drawing Sheets

DUAL FUNCTION AIR CHANNEL FOR GAS BURNER

BACKGROUND

The present disclosure generally relates to appliances, and more particularly to a gas heated oven.

Conventional gas operated cooking appliances such as gas ovens, for example, have one or more burners in which gas is mixed with air and burned. These types of ovens are heated by burning gas, such as natural gas (NG) and vaporized liquid petroleum (LP) gas. Fresh air is drawn in through burner units that mix the gas with the air for combustion. The gaseous products of combustion must be discharged or otherwise escape from the oven cavity.

Typically, a gas oven will include a gas burner located in the bottom portion of the oven that is used for general baking and cooking. This burner will generally be referred to as a bake burner. The gas oven can also include a gas burner at the top of the oven, which is generally referred to as a broil burner. Both the bake burner and the broil burner are generally atmospheric types of gas burners.

Some broil burners have the primary entrances exposed outside of the oven cavity in order to "breath" or deliver fresh air to the broil burner. However, when the oven is in the "bake" mode, the hot flue gases emitted by the bake burner can leak through the open ports of the top broil burner and release into the ambient environment. Such leaking can lead to an undesired heat loss and excessive heating of nearby components, especially for the Infra-red (IR) broil burner, which normally has a large area of port openings compared to the vent opening size. It would be advantageous to be able to provide an external supply of fresh air to the broil burner without heat loss to the oven.

Accordingly, it would be desirable to provide a gas heated oven that addresses the problems identified above.

BRIEF DESCRIPTION OF THE INVENTION

As described herein, the exemplary embodiments overcome one or more of the above or other disadvantages known in the art.

One aspect of the exemplary embodiments relates to a gas oven. In one embodiment, the gas oven includes an oven housing, an oven cavity disposed in the oven housing, an upper gas burner and a lower gas burner, both of which are disposed within the oven cavity, a venturi assembly coupled to the upper gas burner, at least one opening for fresh combustion air for the burners to enter the interior of the oven housing, a channel member communicatively coupled between the opening for clean combustion and the venturi assembly for the upper gas burner.

Another aspect of the exemplary embodiments relates to a gas oven. In one embodiment, the gas oven includes an oven cavity, an upper gas burner disposed within the oven cavity; a venturi assembly coupled to the upper gas burner, a lower burner combustion chamber communicatively coupled to the oven cavity, a lower gas burner disposed within the combustion chamber, and a channel member communicatively coupled between the lower burner combustion chamber and the venturi assembly for the upper gas burner.

Another aspect of the exemplary embodiments relates to a method for operating a gas oven that includes an oven cavity, an upper gas burner and venturi assembly disposed within the oven cavity, a lower gas burner disposed within a lower burner combustion chamber, a channel member communicatively coupling the lower gas burner combustion chamber and the venturi assembly for the upper gas burner and an airflow pathway between the lower burner combustion chamber and the venturi assembly for the upper gas burner. In one embodiment, the method includes operating only the lower gas burner, enabling hot flue gases generated by operation of the lower gas burner to flow through the upper gas burner and into the airflow pathway between the venturi assembly for the upper gas burner and the lower burner combustion chamber, and recirculating the hot flue gases into the lower burner combustion chamber.

These and other aspects and advantages of the exemplary embodiments will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and unless otherwise indicated, they are merely intended to conceptually illustrate the structures and procedures described herein. In addition, any suitable size, shape or type of elements or materials could be used.

DETAILED DESCRIPTION OF THE EXEMPLARY EMBODIMENTS OF THE DISCLOSURE

Figure 1:
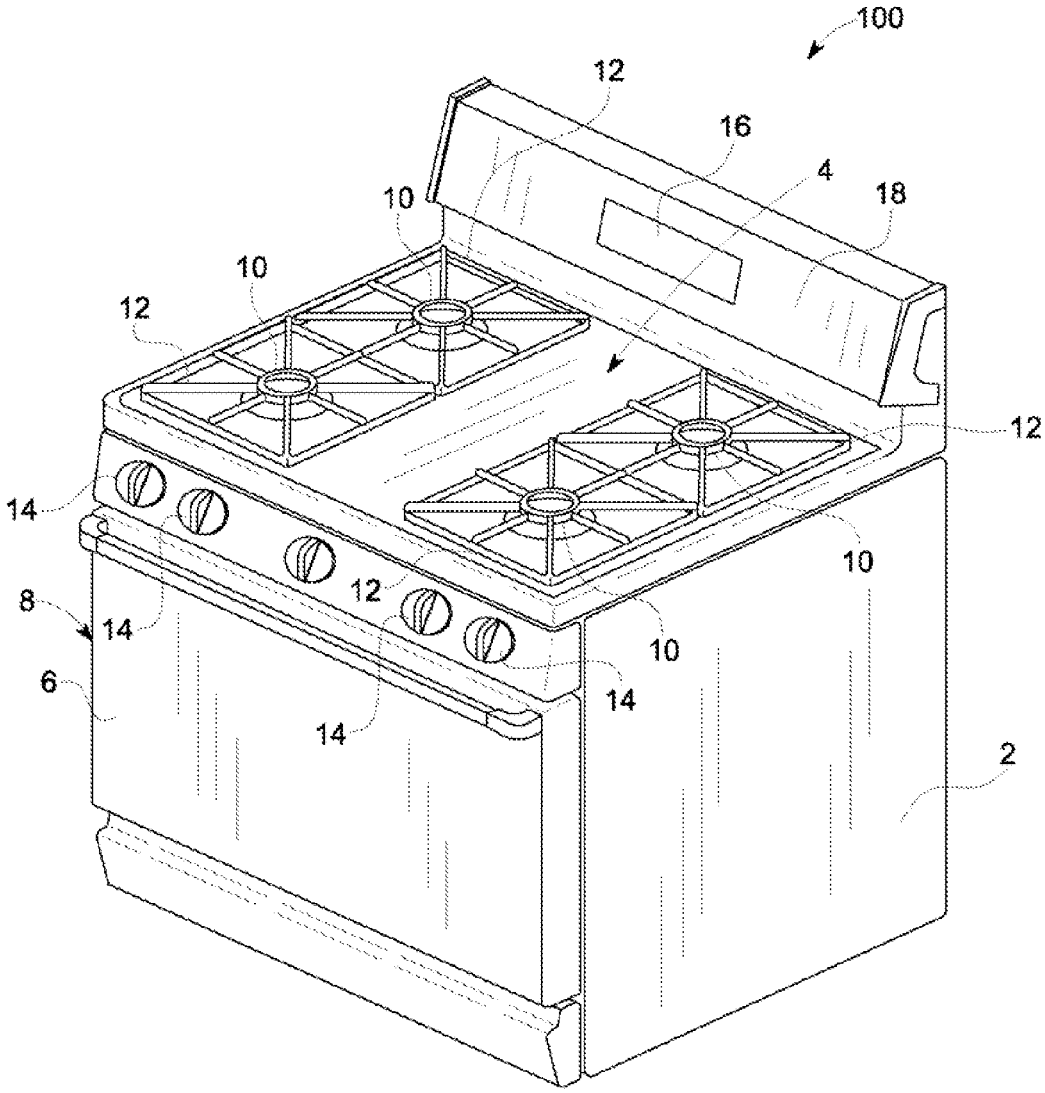
FIG. 1 is a perspective view of an exemplary range incorporating aspects of the disclosed embodiments.

Referring to FIG. 1, an exemplary cooking appliance incorporating aspects of the disclosed embodiments, for example, a free-standing gas range, is generally designated by reference numeral 100. The aspects of the disclosed embodiments are directed to an air channel for a gas oven that improves the efficiency of the oven when bake burner is active. The air channel is configured to reduce heat losses in the oven by recirculating the hot flue gases through the air channel when only the bake burner is active. Although the aspects of the disclosed embodiments will generally be described herein with respect to a cooking appliance, the aspects of the disclosed embodiments can also be applied to other gas operated ovens that include more than one burner.

The appliance 100 shown in FIG. 1 generally includes an outer body or cabinet 2 that incorporates a substantially rectangular cooktop 4. In one embodiment, an oven 8 can be positioned below the cooktop 4 which can include a front-opening access door 6. The cooktop 4 shown in FIG. 1 includes four gas fueled burner assemblies 10 that are positioned in a spaced apart relationship. In alternate embodiments, the cooktop 4 can include any number of gas fueled burner assemblies 10 arranged in any suitable configuration. Each burner assembly 10 generally extends upwardly through an opening in the cooktop 4, and a grate 12 can be positioned over each burner assembly 10. Each grate 12 can include horizontally extending support structures thereon for supporting cooking vessels. Although the gas burner assemblies 10 are shown in FIG. 1 as being substantially similar, in alternate embodiments, the gas burner assemblies 10 can be of different sizes to accommodate different sized cooking vessels. The oven 8 can also include one or more control devices, such as knobs 14 and/or a control panel 16 mounted on or in the backsplash 18 to adjust the oven temperature or operate the oven according to the pre-set working modes. Although the control devices are generally described herein as knobs and/or control panel in alternate embodiments, the control device can comprise any suitable control mechanism, such as a slidable switch or electronic control.

Figure 2:
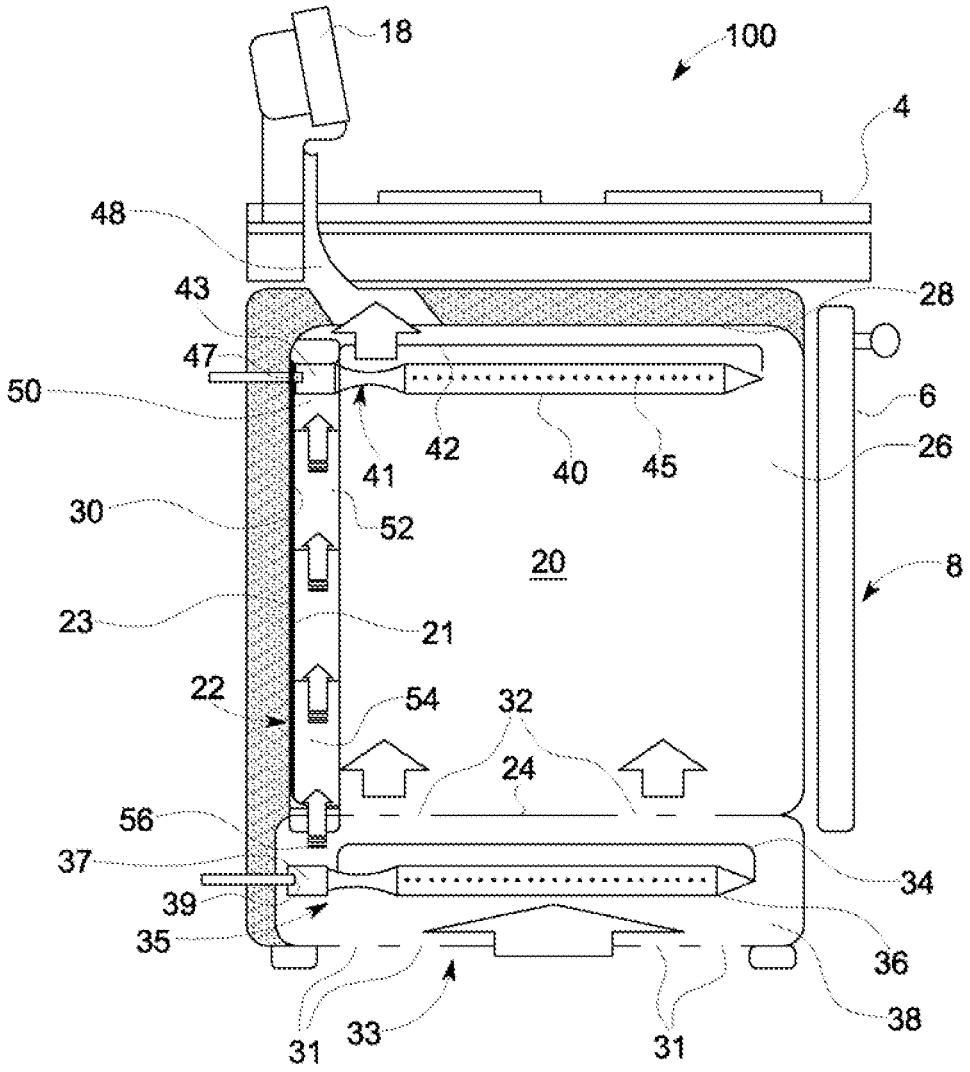
FIG. 2 is a side cross-sectional view of the oven cavity for the oven shown in FIG. 1.

FIG. 2 is a left side cross-sectional view of the appliance 100 shown in FIG. 1. As shown in FIG. 2, the oven 8 includes an oven cavity 20. The oven cavity 20 is formed from a boxlike oven liner 22 in combination with the front-opening access door 6. The oven liner 22 includes a removable bottom panel 24, opposing vertical sidewalls 26 (only one of which is shown in FIG. 2), a top panel 28 and a rear or back wall 30. The rear wall 30 has an inner facing surface 21 and an outer facing or exterior surface 23.

The bottom panel 24 of the oven liner 22 is configured to be removable to enable access to flame spreader 34 and lower gas burner or bake burner assembly 36 which is located in a combustion chamber 38 beneath the bottom panel 24 of the oven liner 22. In one embodiment, the heated exhaust from the bake burner 36 flows into the oven cavity 20 through one or more openings 32 that can be included in the bottom panel 24. As will be understood, the bake burner 36 will include a venturi assembly 35 that has at least one air inlet 37 and a gas orifice 39. Fresh air for combustion is provided through one or more openings or vents 31 along the lower portion 33 of the appliance 100 or other suitable area, in airflow communication with combustion chamber 38 and bake burner 36 as is generally understood.

An upper gas burner, or broil burner assembly 40 is disposed at the top of the oven cavity 20 for use during broiling operations of the oven 8. A flame spreader 42 is typically disposed above the broil burner 40. The broil burner 40 also includes a venturi assembly 41 that has at least one air entrance 43 and a gas orifice 47, as will be understood. The broil burner 40 also includes port openings 45.

As will be generally understood, the bake burner 36 is used during baking operations of the oven 8 and for raising the temperature of the oven cavity 20 to various levels in the range of approximately 170 degrees Fahrenheit to and including 550 degrees Fahrenheit. The broil burner 40 is used during broil operations and can be used to raise the temperature of the oven cavity 20 in a known manner. Temperatures at or near the broil burner 40, when it is active, can be in the range of approximately 1000 up to and including 1100 degrees Fahrenheit.

The gaseous emissions generated by the gas burners 36 and 40 during combustion are generally referred to herein as "flue gases", as that term is generally known and understood in the art. In one embodiment, the direction of flow of the flue gases from the bake burner 36 tend to be within the oven cavity 20, around or past the broil burner 40 and the flame spreader 4 and out the exhaust vent 48. In order to allow the flue gases to escape the oven cavity 20, the exhaust vent 48 is provided in the top panel 28 of the oven liner 22. In alternate embodiments, the exhaust vent 48 can be disposed in the back wall 30 of the oven cavity. The exhaust vent 48 is generally configured to vent the flue gasses out of the oven cavity 20 to the external environment.

As illustrated in FIG. 2, a channel or duct member 50 is disposed along the back wall 30 of the oven liner 22 to provide an air flow path between the lower burner combustion chamber 38 and the venturi assembly 41 of the upper burner 40 and the lower burner combustion chamber 38. The channel member 50 can be attached to, or otherwise located proximate the back wall 30 or other side walls. In the example shown in FIGS. 2-4, the channel member 50 is attached to, or disposed next to, the inner surface or wall 21 of the back wall 30 of the oven liner 22

The channel member 50 includes an upper portion 52 and a lower portion 54. The general shape of the channel member 50 as described herein is substantially rectangular. In alternate embodiments, any suitable geometric shape can be utilized, including a circular or square configuration. A cross-sectional area of the channel member 50 will be suited to the power rating of the particular broil burner. For example, an oven having a broil burner rating of approximately 12-14 kBTU/hr will require a channel member 50 having a cross-sectional area in the range of approximately 1-2 square inches, inclusively. If an optional convection fan is installed in the middle of the back wall 30, the channel member 50 is configured to avoid conflicting with the optional convection fan system.

In one embodiment, the air inlet 43 and the gas orifice 47 of the venturi assembly 41 for the broil burner 40 are covered by an upper portion 52 of the channel member 50. A lower portion 54 of the channel member 50 includes one or more openings 56, referred to herein as the "fresh air entrance." The fresh air entrance 56 is disposed near the bottom of the appliance 100. The fresh air entrance 56 is disposed within the bake burner combustion chamber 38. Channel member 50 is configured to provide a closed or substantially sealed air flow path, so that the primary air supplied to the upper burner 40 is air which enters channel member 50 via the fresh air entrances 31 of the combustion chamber 38.

Figure 3:
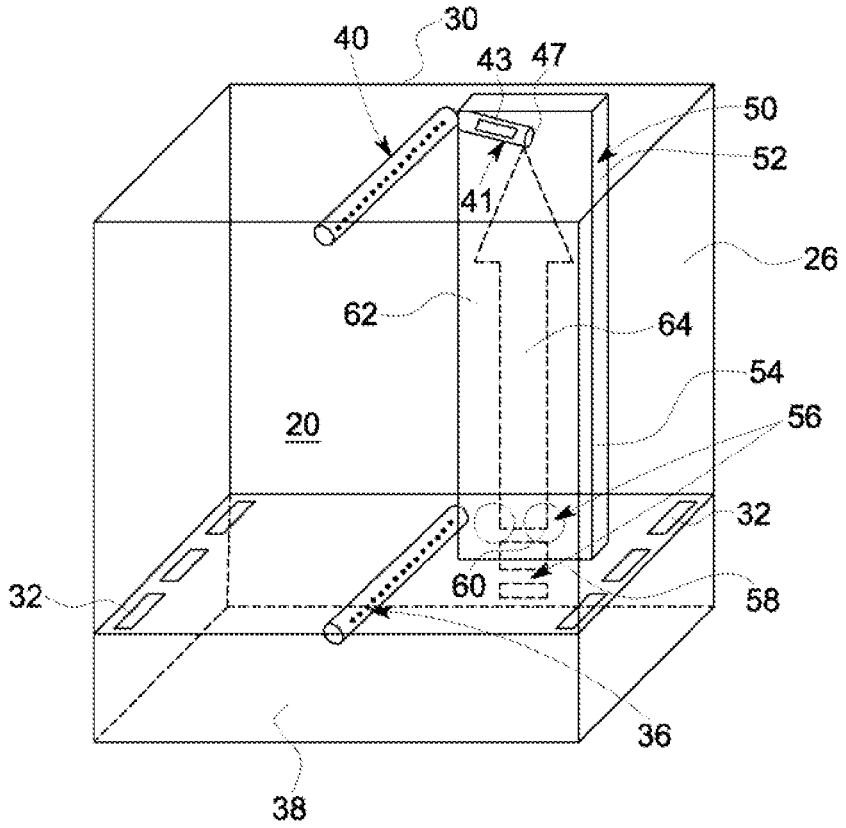
FIG. 3 is a front schematic diagram illustrating air flow paths in a gas oven according to an embodiment of the present disclosure.

FIG. 3 illustrates a front schematic block diagram illustrating the placement of the channel member 50 relative to the oven cavity 20. In this embodiment, the fresh air entrance 56 includes a bottom opening 58, as well as openings 60 in the side wall 62 of the channel member 50. In alternate embodiments, the fresh air entrance 56 can include any suitable number of openings suitably positioned. The upper portion 52 of the channel member 50 is positioned over venturi assembly 41 so substantially all of the primary air required by the broil burner 40 is supplied through the channel member 50. During operation of the broil burner 40, air will be drawn in through the fresh air entrance 56 and travel upwards in direction of airflow 64 to the air inlet 43 of the venturi assembly 41 for the broil burner 40.

Figure 4:
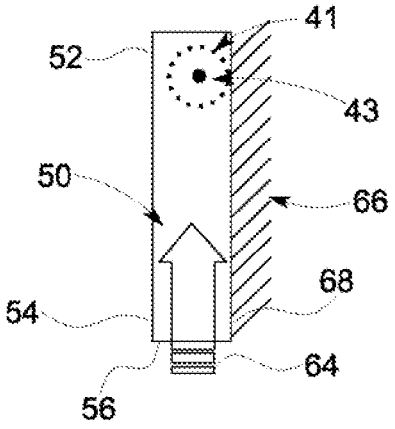
FIG. 4 is a side schematic diagram of the channel and flowpath shown in FIG. 3.

FIG. 4 illustrates a side schematic view of the channel member 50 of FIG. 3. In one embodiment, thermal insulation 66 can be disposed on or near an outer sidewall 68 of the air channel 50. During operation of the broil burner 40, the fresh, primary airflow 64 is drawn in through the fresh air entrance 56 and travels upwards towards the venturi assembly 41. Thus, when the broil burner 40 is active or operational, the broil burner 40 will receive a supply of fresh air, rather than the hot air that is recirculating within the oven cavity 20.

Figure 5:
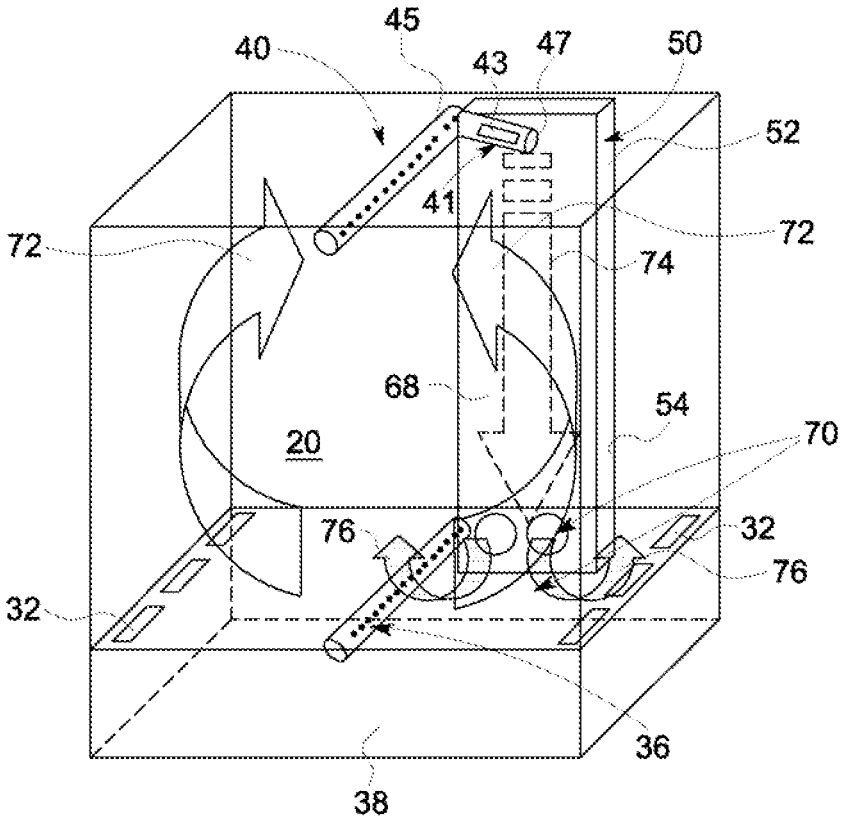
FIG. 5 a front schematic diagram illustrating air flow paths in a gas oven according to an embodiment of the present disclosure.
Figure 6:
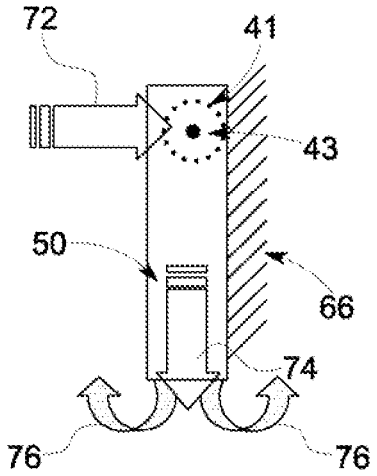
FIG. 6 is a side schematic diagram of the channel and flowpath shown in FIG. 5.

FIG. 5 illustrates an exemplary air flow diagram of the air flow within the oven cavity 20 that includes the channel member 50. In this example, the oven 100 is being operated only in the "bake" mode, meaning that only the bake burner 36 is active. As shown in FIG. 5, the channel member 50 includes one or more openings 56. During operation of only the bake burner 36, the hot flue gases emitted from the bake burner 36 flow upwards as illustrated by the flowpaths 72. Due to the buoyancy of the hot flue gases created by the bake burner 36, the flow restriction introduced by oven vent 48, and the velocity head created when the rising gases impinge on the upper surfaces of oven cavity 20, a portion of the flue gases may enter the port openings 45 in the broil burner 40, which is not operating. This portion of hot flue gases can travel through the broil burner 40 towards the venturi assembly 41 and into the upper portion 52 of the channel member 50. The hot flue gases can travel along the flowpath 74 down towards the lower portion 54 of the channel member 50 and into the bake burner chamber 38, as illustrated by flowpath 76. The recirculated hot flue gases will join the fresh flue gases inside the bake burner chamber 38 and return to the oven cavity 20. FIG. 6 is a side view of the channel member 50 of FIG. 5, illustrating the recirculating flow paths 72, 74 and 76 of the hot flue gases.

Referring again to FIG. 2, the air inlet 37 of the venturi 35 for the bake burner 36 is sufficiently below openings 56 of channel member 50 so that any flue gases traveling along the flowpath 74, as described above with respect to FIG. 5, and emanating from opening 56 do not mix with the cooler, fresh ambient air that enters the venturi assembly 35 of the bake burner 36. In one embodiment, the air inlet 37 is approximately two (2) inches below channel openings 56.

Figure 7:
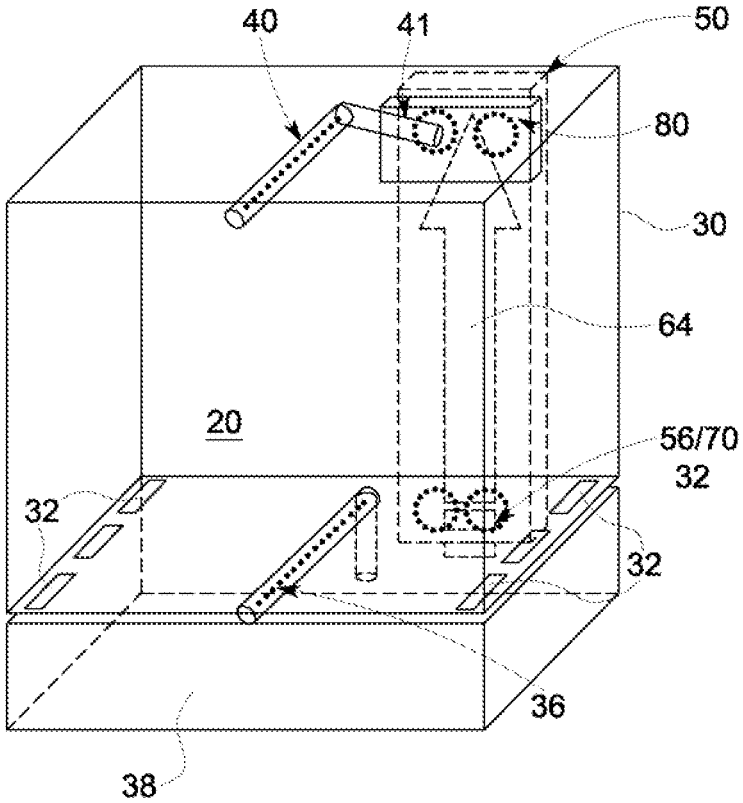
FIG. 7 is a front schematic diagram illustrating air flow paths in a gas oven according to an embodiment of the present disclosure.
Figure 8:
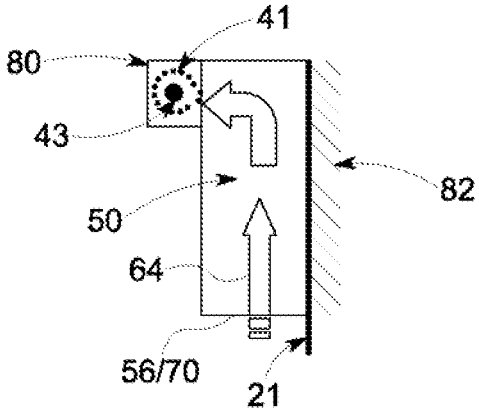
FIG. 8 is a side schematic diagram of the channel and flowpath shown in FIG. 7.

FIGS. 7 and 8 illustrate one embodiment of the present disclosure with the channel member 50 attached to, or disposed adjacent to, the back wall 30 of the oven liner 22 for the oven cavity 20. In this embodiment, the venturi assembly 41 of broil burner 40 is covered by or includes an additional air chamber 80. As is shown in FIGS. 7 and 8, the air chamber 80 is secured to the inner facing surface 21 of the back wall 30, adjacent channel 50, with a suitable opening or air passage there between. In one embodiment, the air chamber 80 is an integral part of the channel member 50 to form a one piece channel member. An insulation member 82, shown in FIG. 8, can be disposed against the back side of channel member 50. The fresh, primary air entrance 56 is located near the bottom of the appliance 100, and or along the body of the channel member 50. During operation of the broil burner 40, the channel member 50 provides a fresh air supply to the broil burner 40 through the air channel 50 and air chamber 80, through the back wall 30 of the oven liner 22. When only the bake burner 36 is active, hot flue gases that enter the broil burner 40 through the port openings 45, travel through the air chamber 80 and into the air channel 50. The hot flue gases then flow out the flue gas outlet(s) 56 and into the bake burner chamber 38.

Thus, while there have been shown, described and pointed out, fundamental novel features of the invention as applied to the exemplary embodiments thereof, it will be understood that various omissions and substitutions and changes in the form and details of devices illustrated, and in their operation, may be made by those skilled in the art without departing from the spirit of the invention. Moreover, it is expressly intended that all combinations of those elements and/or method steps, which perform substantially the same function in substantially the same way to achieve the same results, are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A gas oven comprising:
an oven cavity;
an upper gas burner disposed within the oven cavity;
a venturi assembly coupled to the upper gas burner;
a lower gas burner disposed within a lower burner combustion chamber; and
a channel member, the channel member providing a closed airflow path only between the lower burner combustion chamber and the venturi assembly.

2. The gas oven of claim 1, wherein the channel member comprises an upper portion and a lower portion, the venturi assembly of the upper gas burner being disposed within the upper portion of the channel member.

3. The gas oven of claim 2, wherein the venturi assembly of the upper gas burner comprises an inlet disposed within the channel member.

4. The gas oven of claim 2, further comprising an opening in the lower portion of the channel member.

5. The gas oven of claim 4, further comprising a lower gas burner and flame spreader, wherein the opening in the lower portion of the channel member is positioned below the flame spreader of the lower gas burner.

6. The gas oven of claim 5, further comprising an air inlet in a venturi of the lower gas burner, the air inlet being positioned below the opening in the lower portion of the channel member.

7. The gas oven of claim 1, wherein the channel member is disposed on an interior wall of the oven cavity.

8. The gas oven of claim 1, wherein the channel member is disposed on an exterior wall of the oven cavity.

9. The gas oven of claim 8, further comprising an air chamber disposed against an interior wall of the oven cavity, the venturi assembly being disposed within the air chamber, the air chamber communicatively coupling the venturi assembly and the channel member.

10. The gas oven of claim 1, wherein the channel member comprises a substantially sealed pathway between the lower burner combustion chamber and the venturi assembly.

11. The gas oven of claim 1, wherein the lower burner combustion chamber comprises a fresh air supply.

12. A method of operating a gas oven comprising an oven cavity, an upper gas burner and venturi assembly disposed within the oven cavity, a lower gas burner disposed within a lower burner combustion chamber, a channel member providing a closed airflow pathway only between the lower gas burner combustion chamber and the venturi assembly for the upper gas burner, the method comprising:
operating only the lower gas burner;
enabling hot flue gases generated by operation of the lower gas burner to flow through the upper gas burner and into the venturi assembly for the upper gas burner and through the channel member to the lower burner combustion chamber; and
recirculating the hot flue gases into the lower burner combustion chamber.

13. The method of claim 12, wherein the hot flue gases are recirculated into the lower burner combustion chamber above the venturi assembly for the lower gas burner.

14. The method of claim 12, wherein the hot flue gases flow into the upper gas burner via ports in the upper gas burner.

15. The method of claim 12, wherein substantially all of a primary air supply required for operation of the upper gas burner is provided by the channel pathway between the lower burner combustion chamber and the venturi assembly for the upper gas burner.

16. The method of claim 15, wherein the air supply required for operation of the upper gas burner is separated from contaminated air generated by the lower gas burner.

* * * * *